US008279203B2

(12) United States Patent
Akimoto et al.

(10) Patent No.: US 8,279,203 B2
(45) Date of Patent: Oct. 2, 2012

(54) IMAGE DISPLAY DEVICE

(75) Inventors: Hajime Akimoto, Kokubunji (JP); Toshihiro Sato, Mobara (JP); Naoki Tokuda, Mobara (JP)

(73) Assignees: Hitachi Displays, Ltd., Chiba-ken (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 787 days.

(21) Appl. No.: 11/250,442

(22) Filed: Oct. 17, 2005

(65) Prior Publication Data

US 2006/0082566 A1 Apr. 20, 2006

(30) Foreign Application Priority Data

Oct. 20, 2004 (JP) ..... 2004-305241

(51) Int. Cl.
*G09G 5/00* (2006.01)

(52) U.S. Cl. ..... 345/204; 345/76

(58) Field of Classification Search ..... 345/76–84, 345/204, 211–215
See application file for complete search history.

(56) References Cited

U.S. PATENT DOCUMENTS 6,215,533 B1 * 4/2001 Shigeta et al. ..... 349/37
6,987,521 B2 * 1/2006 Mori et al. ..... 345/690
7,176,947 B2 * 2/2007 Kudo et al. ..... 345/690
7,336,247 B2 * 2/2008 Akimoto et al. ..... 345/82
2003/0085905 A1 5/2003 Mori et al.

FOREIGN PATENT DOCUMENTS

JP 2003-005709 6/2001
JP 2003-122301 10/2001
JP 2003122301 A * 4/2003

OTHER PUBLICATIONS

R.M.A. Dawson, "Design of an Improved Pixel for a Polysilicon Active-Matrix Organic LED Display", SID 98 Digest, pp. 11-14.

* cited by examiner

*Primary Examiner* — Alexander Eisen
*Assistant Examiner* — Christopher E Leiby
(74) *Attorney, Agent, or Firm* — Stites & Harbison, PLLC; Juan Carlos A. Marquez, Esq

(57) ABSTRACT

An image display device capable of controlling in a differentiated manner the signal-brightness characteristics of natural pictures and those of different image sources, such as texts, in the screen frame is to be provided. The image display device is provided with a display area in which are arrayed a plurality of pixels each having a light-emitting device whose brightness is controlled with an image signal output voltage supplied from a signal voltage output circuit. The display area comprises first and second pixel groups of pixels connected to different drive voltage lines. The display area has a display characteristic that the first pixel group and the second pixel group are substantially equal in emission spectrum and differ in light emission brightness relative to the same image signal voltage supplied from the signal voltage output circuit.

18 Claims, 9 Drawing Sheets

IMAGE DISPLAY DEVICE

CLAIM OF PRIORITY

The present application claims priority from Japanese application JP 2004-305241, filed on Oct. 20, 2004, the content of which is hereby incorporated by reference into this application.

FIELD OF THE INVENTION

The present invention relates to an image display device capable of displaying high-quality images.

BACKGROUND OF THE INVENTION

The related art will be described below with reference to FIG. 12 and FIG. 13.

First, the structure of an example of the related art will be described.

FIG. 12 is a pixel circuit of an organic light emitting diode (OLED) display according to the related art. Each of pixels 213 is provided with an OLED element 201, and one end of the OLED element 201 is connected to a common electrode while the other end is connected to a power supply line 212 via an AZB switch 202 and a drive thin film transistor (drive TFT) 203. An AZ switch 204 is connected between the gate and drain of the drive TFT 203, and a memory capacitor 205 is connected between its gate and source. The gate of the drive TFT 203 is connected to a signal line 211 via an offset-cancellation capacitor 206 and a pixel switch 207. Incidentally, the AZB switch 202 is controlled by an AZB control line 208, the AZ switch 204 by an AZ control line 209, and the pixel switch 207 by a gate line 210.

Next, the operation of this example of the related art will be described with reference to FIG. 13.

FIG. 13 is an operation timing chart of writing signal voltages into pixels according to the related art. Since the AZB switch 202, the AZ switch 204 and the pixel switch 207 are pMOSs as shown in FIG. 12, in the waveforms shown in FIG. 13, the lower level corresponds to the ON state of the respective switches, and the upper level, to the OFF state of the same.

In a pixel selected for writing, at first the pixel switch 207 is turned ON in response to a signal SEL on the gate line 210, and the AZ switch 204 is turned ON by the AZ control line 209. As the AZB switch 202 is ON then, a current flows from the power supply line 212 via the drive TFT 203 diode-connected to the OLED element 201.

Next, when the AZB switch 202 is turned OFF in response to a signal on the AZB control line 208, the drive TFT 203 is turned OFF at the time the drain end of the drive TFT 203 has reached a threshold voltage Vth. Signal voltage data (DAT) of a "0 level" is applied then to the signal line 211, and the difference between this voltage and the threshold voltage Vth is entered into the offset-cancellation capacitor 206.

Next, after the AZ switch 204 is turned OFF in response to a signal on the AZ control line 209, an image signal voltage is applied to the signal line 211. A voltage matching the image signal voltage is generated at the gate of the drive TFT 203 as the threshold voltage Vth, and this voltage is caused by the turning-OFF of the pixel switch 207 in response to the signal SEL on the gate line 210 to be stored into the memory capacitor 205. After that, the turning-ON of the AZB switch 202 completes the writing of the signal voltage into the pixels 213, and the OLED element 201 keeps on emitting light at a level of brightness matching the image signal voltage.

Such an example of the related art is described in Non-Patent Document 1 for instance.

Besides that, techniques of modulating and driving OLED elements by using a triangular waveform are disclosed in Patent Document 1 and Patent Document 2.

Patent Document 1: Japanese Patent Laid-Open No. 2003-005709

Patent Document 2: Japanese Patent Laid-Open No. 2003-122301

Non-Patent Document: 1998 SID Digest of Technical Papers, pp. 11-14

SUMMARY OF THE INVENTION

In the examples of the related art described above, the OLED element provided for each pixel can be caused to emit light at a level of brightness corresponding to the image signal voltage. However, the present inventors noticed that luminescence characteristics on the display could not provide sufficiently high picture quality merely by such singular light emission matched with the image signal voltage.

Once, most of images displayed on the television screen used to be natural pictures. On the other hand, images displayed on the screen of the personal computer or the mobile phone are mostly texts. However, in the information-intensive society from now on, images displayed on these screens will be mainly natural picture and text mixtures as is evident on web site pages on the Internet. Then, it will be desirable to optimize the signal-brightness characteristics, typically gamma characteristics and peak brightness, for both natural pictures and texts, but conventional display devices, in which brightness is matched with a single image signal source, cannot differentiate natural pictures from artificial image sources, such as texts, in the screen frame and control the signal-brightness characteristics on the differentiated basis.

An object of the present invention, therefore, is to provide an image display device capable of differentiating in the screen frame natural pictures and non-natural image sources, such as texts, from each other and controlling the signal-brightness characteristics on the differentiated basis.

According to a typical aspect of the present invention disclosed in this specification, an image display device according to the invention has an image signal voltage generating circuit for supplying an image signal voltage; pixels each having a light-emitting device whose brightness is controlled with the image signal voltage and a brightness control unit for the light-emitting device; and a display unit in which a plurality of the pixels are arranged, wherein the apparatus has pixels which are substantially equal in emission spectrum for the same level of the image signal voltage supplied by the image signal voltage generating circuit and differ in light emission brightness.

DETAILED DESCRIPTION OF THE PREFERRED EMBODIMENTS

Preferred embodiments of image display devices according to the present invention will be described in detail below with reference to accompanying drawings.

First Embodiment

The configuration and operation of the first preferred embodiment of image display device according to the invention will be successively described below with reference to FIG. 1 through FIG. 4.

Figure 1:
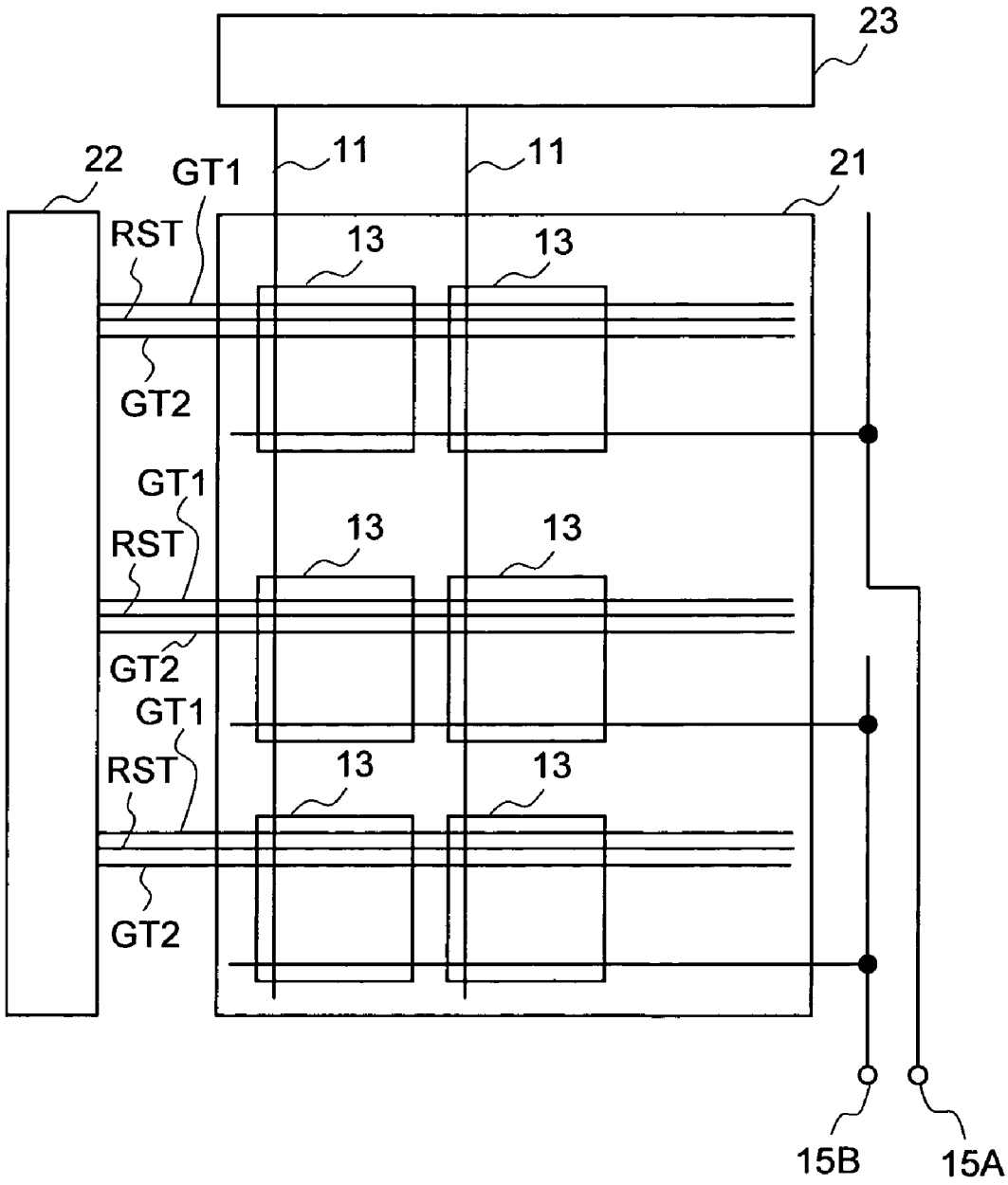
FIG. 1 shows the configuration of an OLED display, which is a first preferred embodiment of image display device according to the present invention.

FIG. 1 shows the configuration of an OLED display for use on a mobile phone. In a display area 21, pixels 13 are arranged in a matrix form. To each of the pixels 13, a signal line 11 is connected in the vertical direction, and a reset line RST, a gate line GT1 and a gate line GT2 (hereinafter collectively referred to as gate lines) are connected in the horizontal direction to be described in detail afterwards. One end of the signal line 11 is connected to a signal voltage output circuit 23, and each one end of the reset line RST and the gate lines GT1 and GT2, to a scanning circuit 22.

Figure 2:
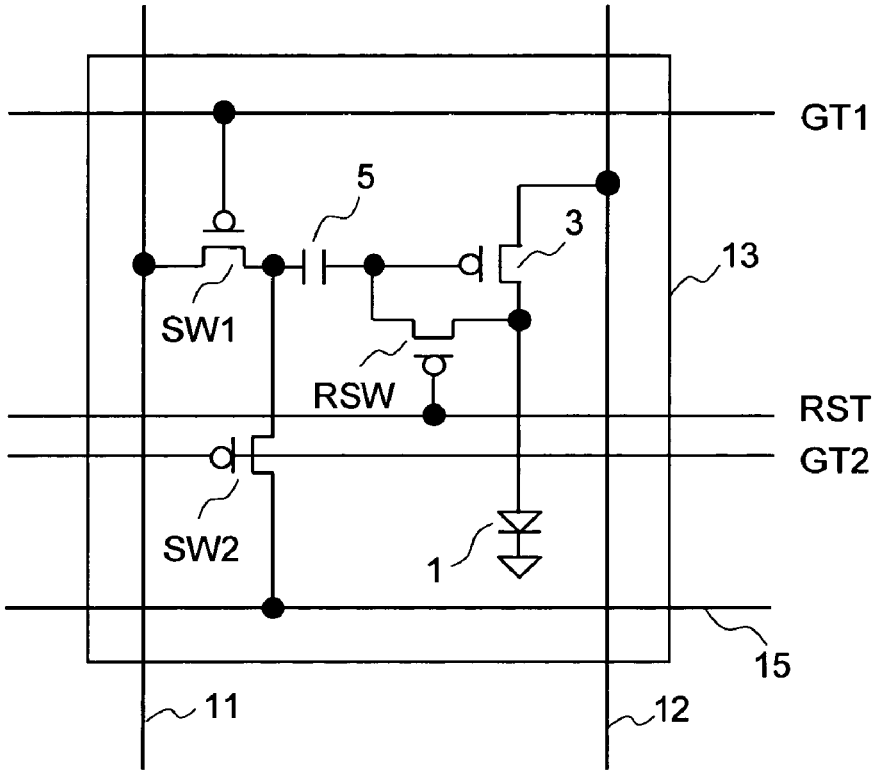
FIG. 2 is a pixel circuit diagram of the first preferred embodiment.

Although only six pixels are shown in FIG. 1 for the sake of simplifying the drawing, actually a pixel drive signal line 15A inputs signals to pixels in the upper part of the drawing, covering 240 (horizontal)×RGB×50 (vertical) pixels. A pixel drive signal line 15B covers 240 (horizontal)×RGB×320 (vertical) pixels. All the pixels in the display area 21 are the same in pitch size. Both the pixels entered via the pixel drive signal line 15A and those entered via the pixel drive signal line 15B are uniformly arranged consecutively. Further, the illustration of a power supply line 12 shown in FIG. 2 is also dispensed with in FIG. 1 to avoid complexity. All the pixels in the display area 21 are disposed over the same glass substrate.

Next will be described the configuration of the pixels 13. FIG. 2 is a pixel circuit diagram of the pixels 13. Each of the pixels 13 is provided with an OLED element 1. One end of the OLED element 1 is connected to a common electrode, and the other end is connected to the power supply line 12 via the drive TFT 3. A reset switch 4 is connected between the gate and drain of the drive TFT 3. The gate of the drive TFT 3 is connected to the signal line 11 via a memory capacitor 5 and a pixel switch SW1 and to the pixel drive signal lines 15 via a pixel switch SW2. A reset switch RSW is controlled via the reset line RST, the pixel switch SW1 via the gate line GT1, and the pixel switch SW2 via the gate line GT2.

Next, the operation of this embodiment will be described with reference to FIG. 3.

Figure 3:
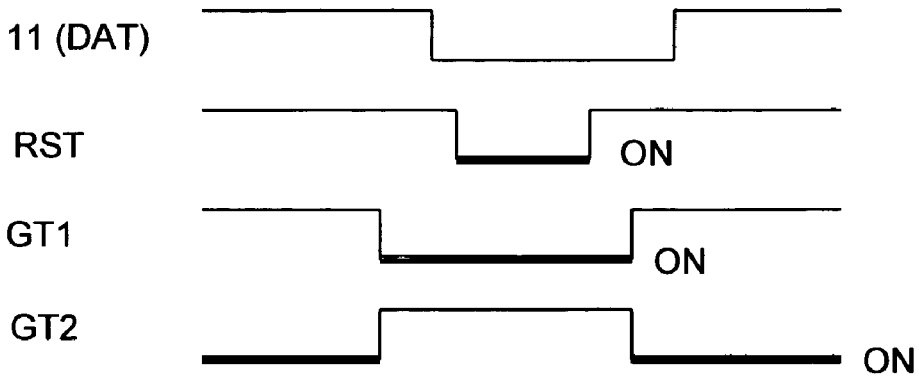
FIG. 3 is an operation timing chart of the first embodiment.

FIG. 3 is an operation timing chart of signal voltage writing into pixels in this embodiment. Since the reset switch RSW controlled by the reset line RST, the pixel switch SW1 controlled by the gate line GT1 and pixel switch SW2 controlled by the gate line GT2 here are pMOSs as shown in FIG. 2, the lower level of the waveforms shown in FIG. 3 corresponds to the ON state of the respective switches, and the upper level, to the OFF state of the same.

In a pixel selected for writing, at first the switch-over of the signal voltages on the gate line GT1 and the gate line GT2 causes the signal line 11 to be connected to one end of the memory capacitor 5.

Then, when an image signal voltage is inputted to the signal line 11 and at the same time the reset switch RSW is turned ON by the reset line RST, the drive TFT 3 and the OLED element 1 together operate as an inverter circuit whose input end and output end are short-circuited by the reset switch RSW. The input voltage to the inverter circuit, whose load then is the OLED element 1, is reset to the middle point of the logical threshold of the inverter circuit.

As a result, the middle point voltage between the image signal voltage and the logical threshold of the inverter circuit is inputted to both ends of the memory capacitor 5. This state of the memory capacitor 5 is held by the turning-OFF of the reset switch RSW by the reset line RST.

Then, the switch-over of a gate 1 line 10 and a gate 2 line 14 causes the pixel drive signal lines 15 to be connected to one end of the memory capacitor 5 at any other timing than that of write operation. A prescribed drive voltage is inputted here to the pixel drive signal lines 15 in this embodiment. This point will be described below with reference to FIG. 4.

Figure 4:
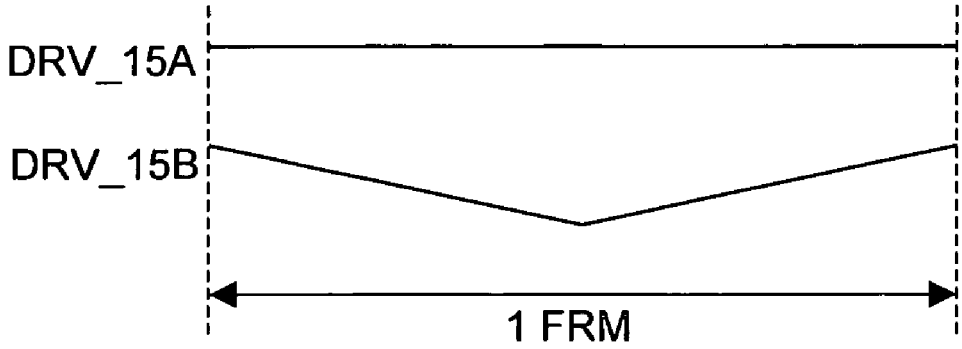
FIG. 4 is a waveform chart of a drive voltage DRV in the first embodiment.

FIG. 4 shows the waveforms in one frame period (FRM) of the drive voltages DRV applied to the pixel drive signal lines 15 in this embodiment. Here, one frame period is set to be 1/60 second. As is evident from the chart, the drive voltages DRV applied to the pixel drive signal lines 15 are differentiated between the pixel drive signal line 15A and the pixel drive signal line 15B. Thus, while a drive voltage DRV_15A applied to the pixel drive signal line 15A is a constant voltage, a drive voltage DRV_15B applied to the pixel drive signal line 15B is one symmetric triangular waveform having a convex downward. This results in differences in light emitting operation between pixels to which a signal voltage is applied from the pixel drive signal line 15A and pixels to which a signal voltage is applied from the pixel drive signal line 15B.

In the pixels to which the signal voltage of the pixel drive signal line 15A is applied, a voltage applied as the gate voltage of the drive TFT 3 corresponds to the difference between the image signal voltage and the constant drive voltage DRV_15A, applied to the pixel drive signal line 15A, with respect to the middle point voltage of the logical threshold of the inverter circuit. Therefore, the OLED element 1 keeps on emitting light at a luminous intensity matching the image signal voltage until the next write period.

On the other in the pixels to which the signal voltage of the pixel drive signal line 15B is applied, the gate voltage of the drive TFT 3 is driven by the drive voltage DRV_15B of the triangular waveform, which is convex downward, applied to the pixel drive signal line 15B. Since the gate voltage of the drive TFT 3 is the earlier mentioned middle point voltage of the logical threshold of the inverter circuit at the moment when the drive voltage DRV_15B of the triangular waveform becomes identical with the image signal voltage, the OLED element 1 is in an intermediate state between being lit and being extinguished. Since the output logic of the inverter is OFF when the drive voltage DRV_15B of the triangular waveform is higher than the image signal voltage, the OLED element 1 is not lit. On the other hand, as the output logic of the inverter is ON when the drive voltage DRV_15B of the triangular waveform is lower than the image signal voltage the OLED element 1 is lit.

Therefore, the duration of lighting of the OLED element 1 within one frame period is determined whether the image signal voltage is higher or lower than the triangular waveform drive voltage. This enables brightness gradations to be realized by keeping the OLED element 1 lit for a duration matching the image signal voltage.

In this embodiment, as described above, by wiring the two pixel drive signal lines 15A and 15B to different pixel groups, different signal-brightness characteristics can be achieved even with the same image signal voltage supplied by a single signal voltage output circuit 23. Of the two pixel areas to which signal voltages are applied from the different pixel drive signal lines 15A and 15B, one is an area for displaying mainly texts and icons and the other, an area for displaying images in general, including natural pictures.

Further by adjusting independent of each other the constant drive voltage DRV_15A and the drive voltage DRV_15B of the triangular waveform, which is convex downward, the depth of black and the brightness of white can obviously regulated independent of each other.

It deserves particular note that a "peak brightness" characteristic is realized for the group of pixels to which the drive voltage DRV_15B of the triangular waveform is applied and achieves brightness gradations by keeping the OLED element 1 lit for a duration matching the image signal voltage, the pixels to which the signal voltage of the pixel drive signal line 15B is applied. The "peak brightness" characteristic means that, where whole frame is displayed in white, the light emission brightness of local bright spots is made several times higher than that of other parts to express glittering. This is a function actually used in cathode ray tubes (CRTs).

Whereas light emission by the pixel groups is basically controlled by choosing one of two states, ON and OFF, the light emission brightness in the ON state here is basically determined by the voltage of the power supply line 12. When most of the pixels emit light, the light emission current supplied by the power supply line 12 becomes greater, inevitably resulting in a voltage drop on the power supply line 12. In this state where most of the pixels emit light, the light emission brightness of the OLED element 1 drops. Conversely, when only localized pixels emit light, the light emission current supplied by the power supply line 12 is small, and the voltage drop on the power supply line 12 is negligible. In this localized lighting of pixels, the earlier mentioned drop in the light emission brightness of the OLED element 1 does not occur. In this way, the "peak brightness" characteristic is particularly realizable for this pixel group to which the signal voltage from the pixel drive signal line 15B is applied. In this way, the pixel group to which the signal voltage from the pixel drive signal line 15B is applied can express high grade natural pictures.

On the other hand, in the pixel group to which the signal voltage from the pixel drive signal line 15A is applied, as the light emission brightness of the OLED element 1 is controlled by the gate voltage of the drive TFT 3, basically there is no "peak brightness" characteristic though there is intensity modulation by a few tens of percent. However, since the pixel group to which the signal voltage from the pixel drive signal line 15A is applied consists of pixels for displaying solely texts and icons, it is preferable not to have the "peak brightness" characteristic, because it is undesirable for the brightness of texts and icons to vary every time the images of natural pictures of the pixel group to which the signal voltage from the pixel drive signal line 15B is applied.

As described above, this embodiment can optimize the pixel luminescence characteristics in respect of the "peak brightness" characteristic aspect as well.

Although TFTs in the pixels are supposed to be pMOS transistors formed of polycrystalline Si in this embodiment, nMOS transistors can be used as appropriate if the positivity or negativity of each control voltage is reversed. Also the material is not limited to polycrystalline Si, but any other suitable organic/inorganic semiconductor thin film can used for the transistors.

Nor do the light-emitting devices need to be OLED elements, but general light-emitting devices, such as inorganic EL elements or field-emission diodes (FEDs), obviously can be used instead.

Furthermore, though pixels are divided into two groups in this embodiment, it is evidently permissible to divide them into a greater number of groups.

Incidentally, the technique of modulating and driving OLED elements during the period of light emission by using the triangular waveform described with respect to this embodiment is described in detail in Patent Document 1, Patent Document 2 and other references.

Second Embodiment

A second preferred embodiment of image display device according to the invention will be described below with reference to FIG. 5.

In this second embodiment, the configuration of the OLED display, the pixel circuit and its basic operating method are almost the same as their respective counterparts in the first embodiment already described. Since the difference from the first embodiment consists in the waveform of the drive voltage DRV applied to the pixel drive signal lines 15 in one frame period, this aspect alone will be described below with reference to FIG. 5.

Figure 5:
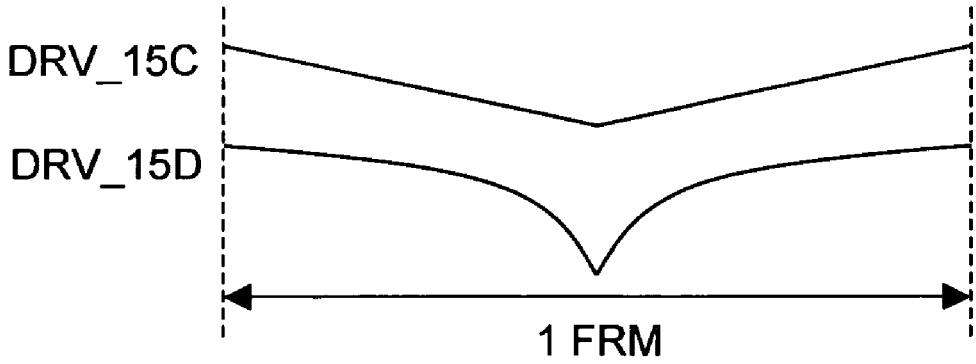
FIG. 5 is a waveform chart of a drive voltage DRV in a second preferred embodiment.

FIG. 5 shows the waveform of the drive voltage DRV applied to the pixel drive signal lines 15 in one frame period (1 FRM) in this embodiment. Here again, one frame period is set to 1/60 second. As is evident from the chart, the drive voltages DRV applied to the pixel drive signal lines 15 are prescribed to be a pixel drive voltage DRV_15C in place of the pixel drive voltage DRV_15A in the first embodiment and a pixel drive voltage DRV_15D in place of the pixel drive voltage DRV_15B in the first embodiment.

Here, while the drive voltage DRV_15C applied to the pixel drive signal line 15A has a triangular waveform composed of straight lines, the drive voltage DRV_15D applied to the pixel drive signal line 15B has a triangular waveform composed of curves convex upward. This results in differences in light emitting operation between pixels to which the drive voltage is applied from the pixel drive signal line 15A and pixels to which the drive voltage is applied from the pixel drive signal line 15B.

While in this embodiment brightness gradations are realized by the lighting of the OLED element 1 of every pixel during a light emitting period matching the image signal voltage, as pixels to which the drive voltage DRV_15C from the pixel drive signal line 15A is inputted and pixels to which the drive voltage DRV_15D from the pixel drive signal line 15B is inputted differ in the waveform of the drive voltage DRV, and accordingly their gamma characteristics differ from each other. For this reason, in this embodiment too, different signal-brightness characteristics can be realized even with respect to the same image signal voltage from a single signal voltage output circuit 23 by wiring the two different pixel drive signal lines to different pixel groups.

In this embodiment too, of the two pixel areas to which signal voltages are applied from the different pixel drive signal lines 15A and 15B, one is an area for displaying mainly texts and icons and the other, an area for displaying images in general, including natural pictures, the latter being given stronger gamma characteristics. Further, it is obviously possible by adjusting independent of each other the shapes of the drive voltages DRV_15C and DRV_15D, to regulate independent of one another not only the gamma characteristics but also the depth of black and the brightness of white.

Third Embodiment

Figure 6:
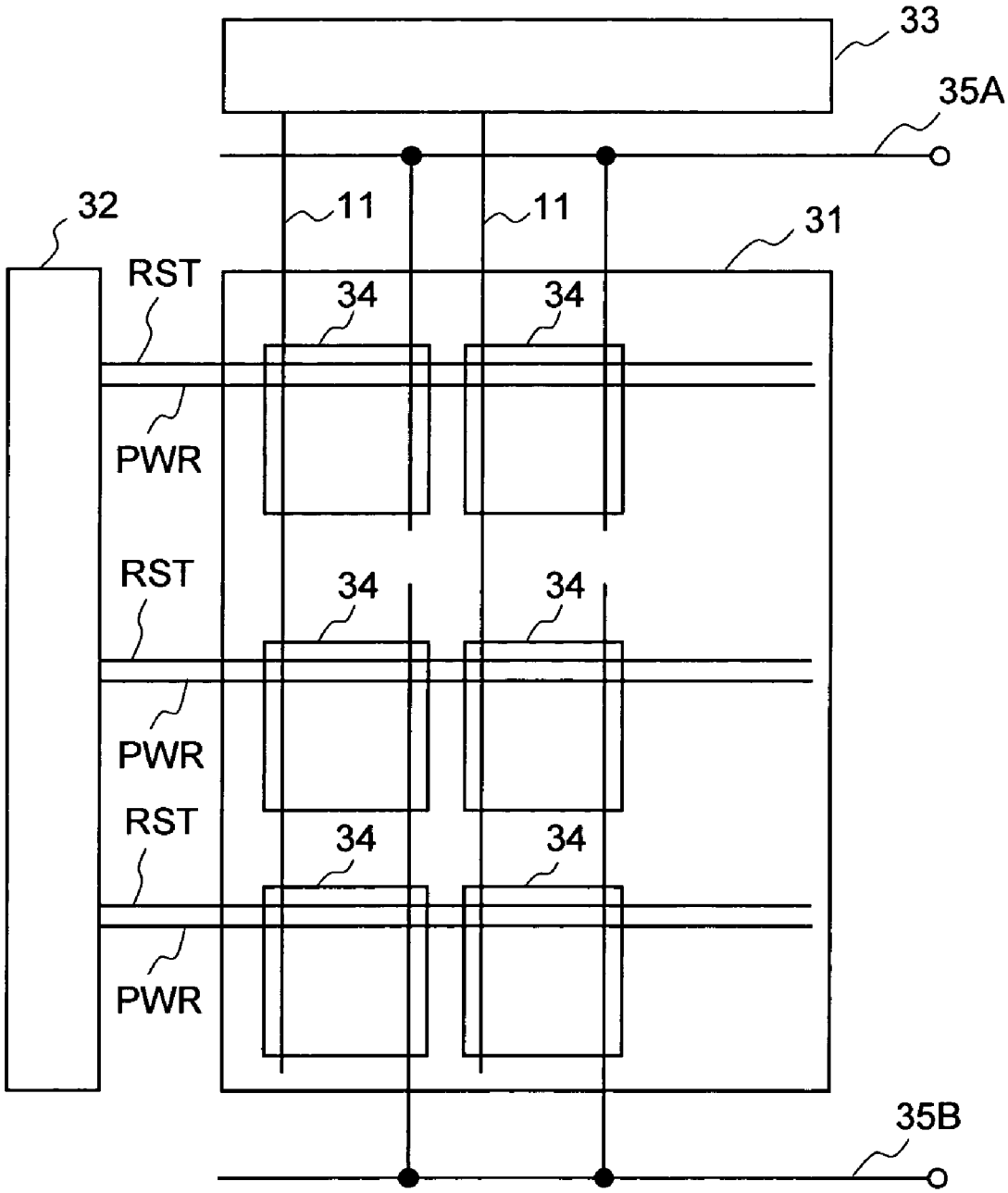
FIG. 6 shows the configuration of an OLED display, which is a third preferred embodiment of image display device according to the invention.

A third preferred embodiment of image display device according to the present invention will be described with reference to FIG. 6 through FIG. 8. FIG. 6 shows the configuration of an OLED display for use on a mobile terminal. In a display area 31, pixels 34 are arranged in a matrix for, and the signal lines 11 are connected to the pixels 34 in the vertical direction while in the horizontal direction, as will be described in detail afterwards, the reset line RST and a power supply control line 8 are connected to them. One end of the signal line 11 is connected to a signal voltage output circuit 33, and each one end of the reset line RST and of the power supply control line 8, to a scanning circuit 32. As shown in FIG. 6 here, the pixels are divided into a pixel group to which a power supply line 35A is connected and a pixel group to which a power supply line 35B is connected, and different power voltages are inputted to the power supply line 35A and the power supply line 35B.

Although only six pixels are shown in FIG. 6 for the sake of simplifying the drawing, actually VGA (640×480) pixels are provided. The number of pixels inputted from the power supply line 35A is 640 (horizontal)×RGB×380 (vertical), and that of pixels inputted from the power supply line 35B, 640 (horizontal)×RGB×100 (vertical). All the pixels in the display area 31 are the same in pitch size, and both the pixels to which the power supply line 35A is connected and those to which the power supply line 35B is connected are uniformly arranged consecutively. All the pixels in the display area 31 are disposed over the same glass substrate.

Next will be described the configuration of the pixels 34.

Figure 7:
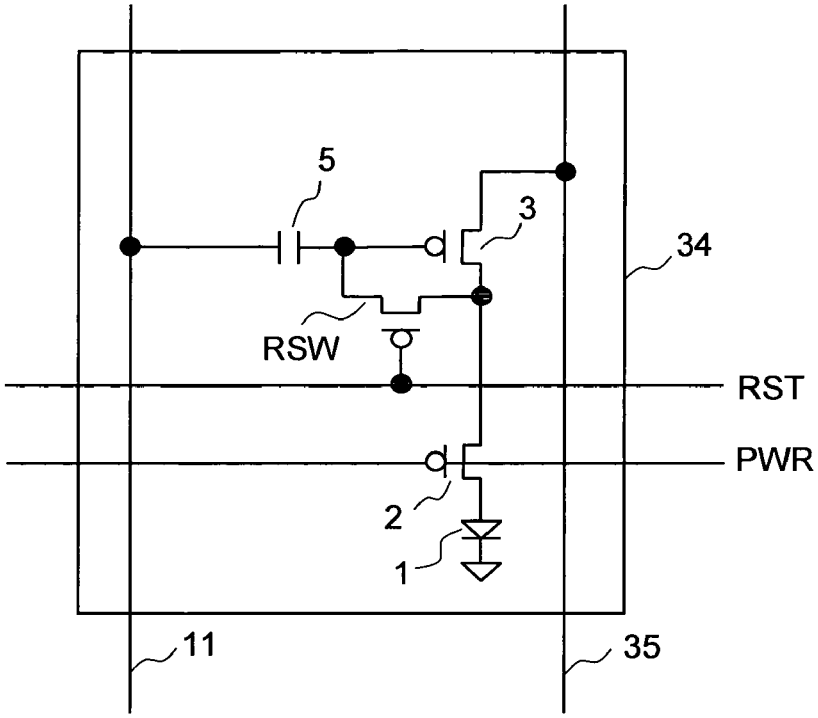
FIG. 7 is a pixel circuit diagram of the third embodiment.

FIG. 7 is a pixel circuit diagram of the pixels 34. Each of the pixels 34 is provided with an OLED element 1. One end of the OLED element 1 is connected to a common electrode, and the other end is connected to the power supply line 35 via a power supply control switch 2 and the drive TFT 3. The reset switch RSW is connected between the gate and drain of the drive TFT 3. The gate of the drive TFT 3 is connected to the signal line 11 via a memory capacitor 5. The reset switch RSW is controlled by the reset line RST and the power supply control switch 2, by a power supply control line PWR.

Next, the operation of this embodiment will be described with reference to FIG. 8.

Figure 8:
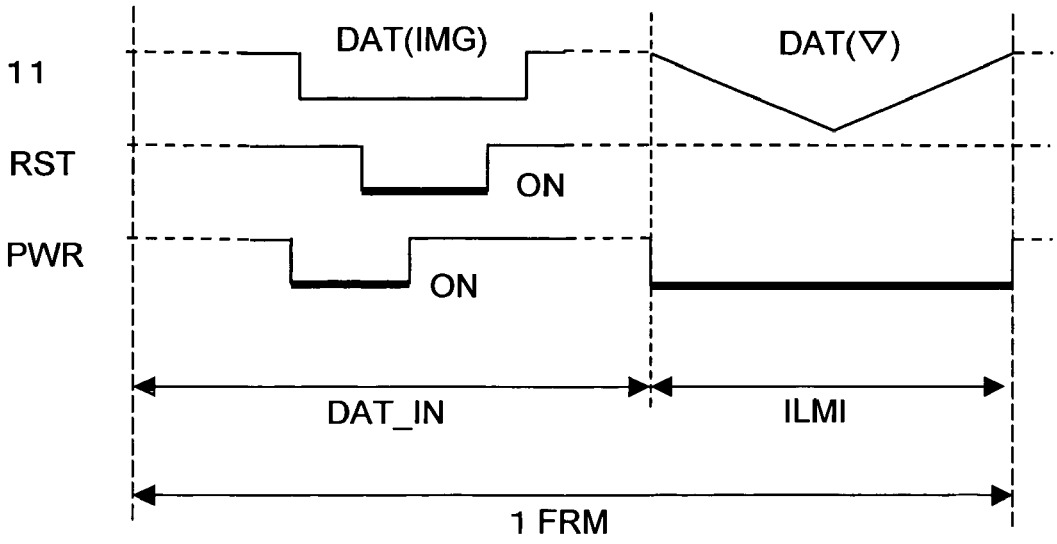
FIG. 8 is an operation timing chart of the third embodiment.

FIG. 8 is an operation timing chart of the pixels in this embodiment. The data input period DAT_IN in the first half corresponds to the period of writing signal voltages into pixels, and the ILMI period in the latter half, to the period of gradation emitting by the pixels. Since the reset switch RSW and the power supply control switch 2 here are pMOSs as shown in FIG. 7, the lower level of the waveforms shown in FIG. 8 corresponds to the ON state of the respective switches, and the upper level, to the OFF state of the same.

In a pixel selected for writing, at first the switch-over of the power supply control line PWR causes the OLED element 1 to be connected to the drive TFT 3. Then, when the reset switch RSW is turned ON by the reset line RST, the drive TFT 3 and the OLED element 1 diode-connected by the reset switch RSW are connected to the power supply line 35 by the power supply control switch 2, and a current begins to flow.

Next, as the power supply control line PWR is turned OFF to cause the power supply control switch 2 to go OFF, the drive TFT 3 is turned OFF at the time the drain end of the drive TFT 3 comes to the threshold voltage Vth. Image signal voltage data DAT (IMG) are then applied to the signal line 11, and the difference between the image signal voltage data DAT (IMG) and the threshold voltage Vth is entered into the memory capacitor 5.

Next, when the reset switch RSW is turned OFF by the reset line RST, the writing of the signal voltage into this pixel is completed. In this way, the writing of the signal voltage into each pixel is successively accomplished during the data input period DAT_IN in the first half.

When the writing into the pixels is completed, it is followed by the ILMI period in the latter half, which is the period of gradation emitting by the pixels. During this period, voltage data DAT (∇) of a triangular waveform convex downward are inputted to the signal line 11 as shown in FIG. 8. The moment when the voltage DAT (∇) on the signal line 11 becomes identical with the earlier written image signal voltage data DAT (IMG), since the gate voltage of the drive TFT 3 is the earlier mentioned threshold voltage Vth, the OLED element 1 enters into an intermediate state between being lit and being extinguished. If the voltage of the triangular waveform data DAT (∇) on the signal line 11 is higher than the image signal voltage data DAT (IMG), the drive TFT will be turned OFF, and accordingly the OLED element 1 will not be lit. If the voltage of the triangular waveform data DAT (∇) on the signal line 11 is lower than the image signal voltage data DAT (IMG), the drive TFT will be turned ON, and accordingly the OLED element 1 will be lit.

Therefore, the duration of lighting of the OLED element 1 within one frame period is determined whether the pre-written image signal voltage DAT (IMG) is higher or lower than the triangular waveform voltage DAT (∇) applied to the signal line 11. This enables brightness gradations to be realized by keeping the OLED element 1 lit for a duration matching the image signal voltage.

The pixels then are divided into one pixel group to which the power supply line 35A is connected and another to which the power supply line 35B is connected as shown in FIG. 6, and different power voltages are inputted to the power supply line 35A and the power supply line 35B. For this reason a difference in light emission brightness arises between the pixel group to which the power supply line 35A is connected and the pixel group to which the power supply line 35B is connected when the OLED element 1 is turned ON. Of the two pixel areas to which signal voltages are applied from the different pixel drive signal lines 35A and 35B, one is an area for displaying images in general, including natural pictures and the other, a character displaying area for mainly texts.

By providing then a relatively high voltage to the power supply line 35A via a prescribed output impedance, the pixel group to which the power supply line 35A is connected is enabled to display images of high brightness including peak brightness. Also, by providing a relatively low voltage to the power supply line 35B, the pixel group connected to the power supply line 35B is enabled to display images of relatively low brightness hardly involving peak brightness.

To add, this embodiment is enabled to accomplish even finer picture quality control by being provided with a plurality of power supply lines 35, one for each display color out of RGB. Further by controlling the power voltage to be applied to the power supply line or lines 35 on a real time basis according to differences in image, even more appropriate picture quality control can be achieved.

Fourth Embodiment

A fourth preferred embodiment of image display device according to the invention will be described below with reference to FIG. 9.

Figure 9:
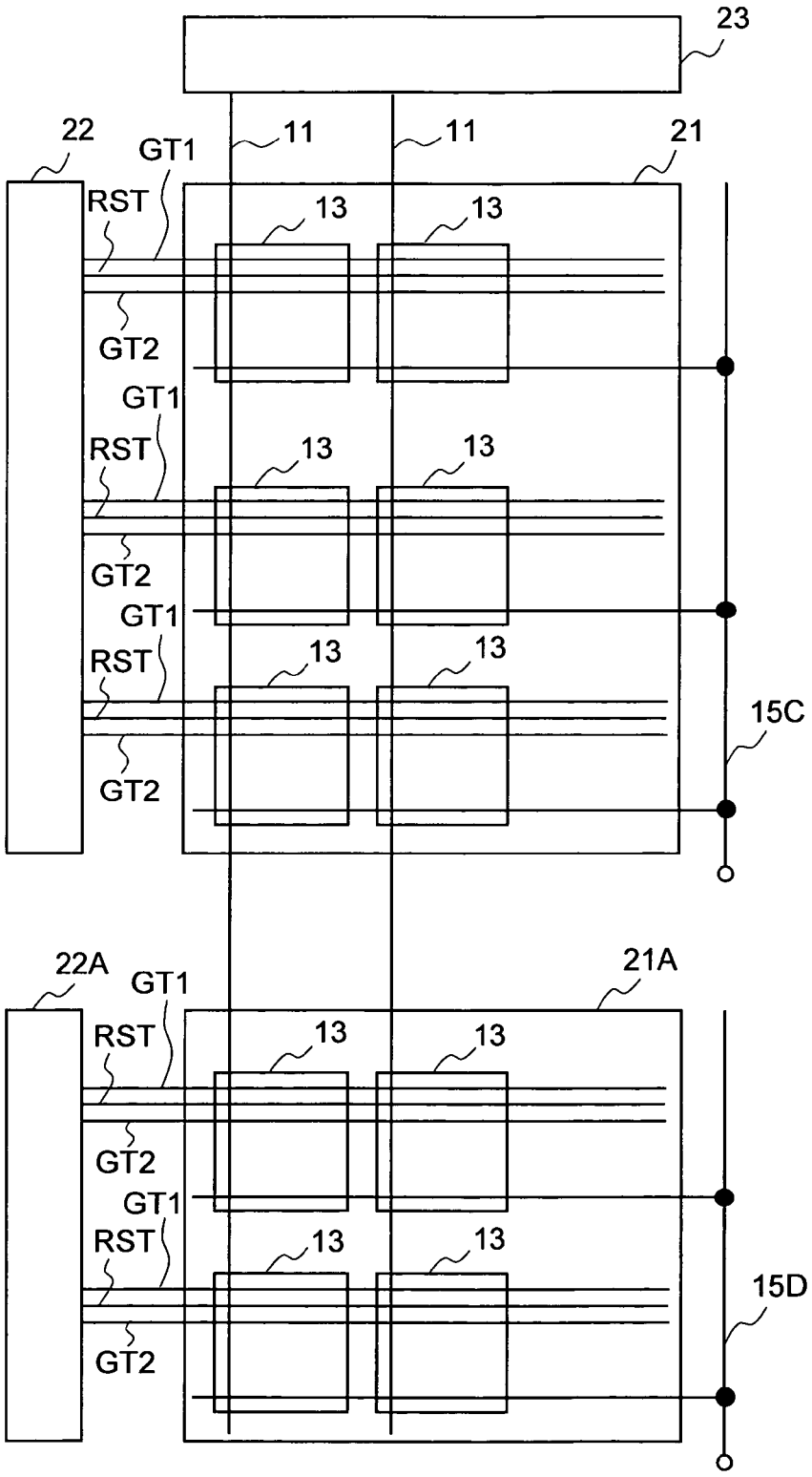
FIG. 9 shows the configuration of an OLED display, which is a fourth preferred embodiment of image display device according to the invention.

FIG. 9 shows the configuration of an OLED display having a main panel and a subpanel for use in a mobile phone. A display area 21 and a display area 21A respectively correspond to the main panel and the subpanel, in each of which pixels 13 are arranged in a matrix form. The signal lines 11 are connected to the pixels 13 in the vertical direction, and in the horizontal direction the reset line RST, the gate line GT1 and the gate line GT2 are connected to them as in the first embodiment. For both the display area 21 and the display area 21A, each one end of the signal lines 11 is commonly connected to the signal voltage output circuit 23, and each one end of the reset line RST and the gate lines GT1 and GT2, to scanning circuits 22 and 22A, respectively, in the display area 21 and the display area 21A.

Although only six and four pixels are shown in the display area 21 and the display area 21A, respectively, in FIG. 9 for the sake of simplifying the drawing, actually the number of pixels corresponding to the display area 21 is 240 (horizontal)×RGB×320 (vertical), and that corresponding to the display area 21A is 160 (horizontal)×RGB×120 (vertical). For this reason, 80 signal lines in the display area 21 are superfluous toward the right hand end, which is not illustrated. Herein, a pixel drive signal line 15C is connected to pixels corresponding to the display area 21, and a pixel drive signal lines 15D is connected to pixels corresponding to the display area 21A. All the pixels in the display area 21 are the same in pitch size and so are those in the display area 21A, but there is a difference in pixel pitch size between the display area 21 and the display area 21A. All the pixels in the display area 21 are disposed over the same glass substrate, and those in the display area 21A are disposed over the same glass substrate, but the two areas use different glass substrates.

This embodiment here operates in the same way and has the same features as the first embodiment if the pixel drive signal lines 15C and 15D in the first embodiment are read the pixel drive signal lines 15B and 15A except that the main panel and the subpanel use different glass substrates.

While images in general, including natural pictures, are displayed on the main panel of a mobile phone, images displayed on the subpanel are mostly texts and icons. Therefore, where this embodiment is applied to a mobile phone, improvement of the picture quality on the main panel of the mobile phone and of the readability of characters displayed on the subpanel can be achieved at the same time by optimizing the respective signal-brightness characteristics of the main panel and the subpanel.

Fifth Embodiment

A fifth preferred embodiment of image display device according to the invention will be described with reference to FIG. 10.

Figure 10:
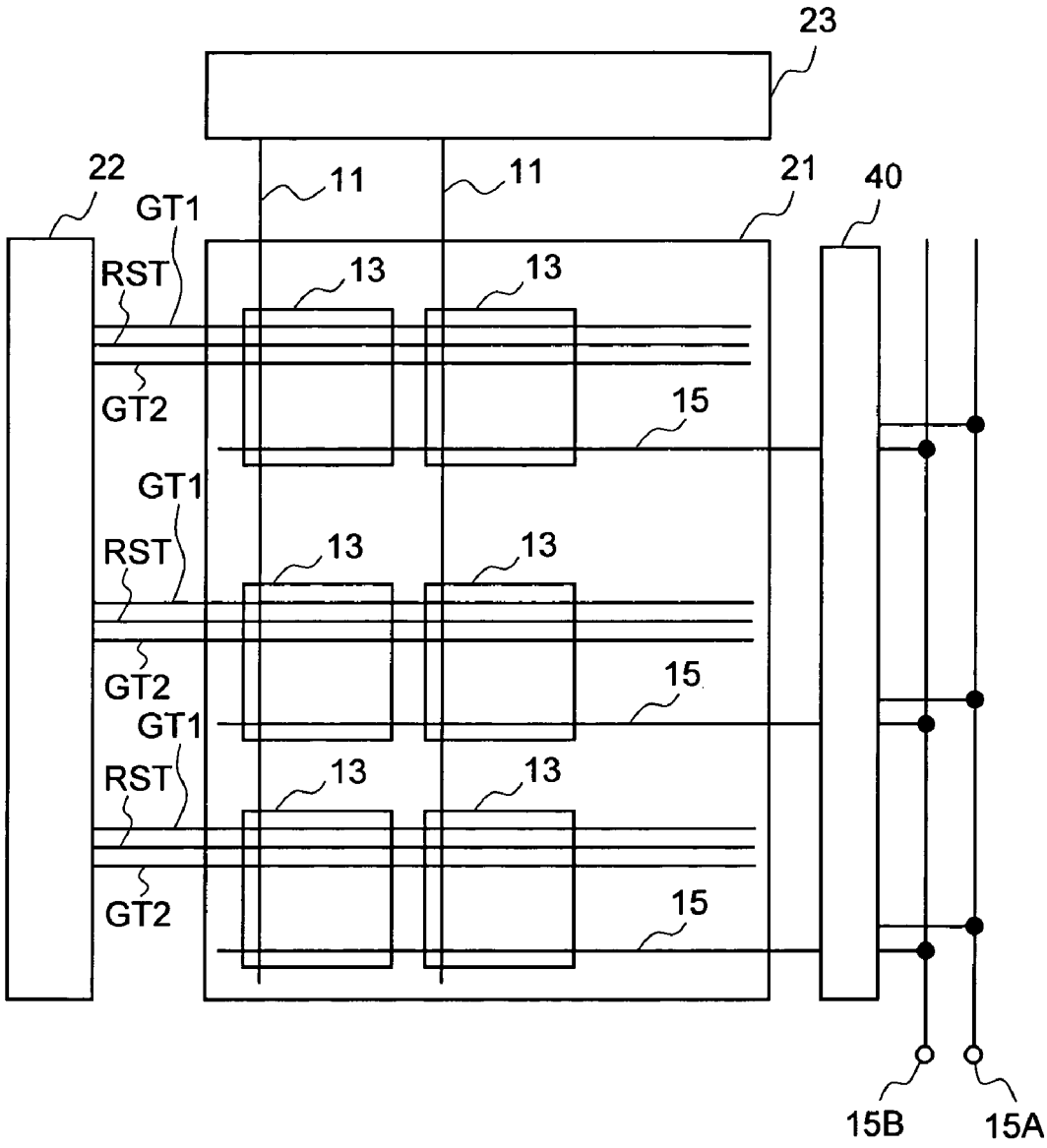
FIG. 10 shows the configuration of an OLED display, which is a fifth preferred embodiment of image display device according to the invention.

FIG. 10 shows the configuration of an OLED display for use in mobile phones. In the display area 21, pixels 13 are arranged in a matrix form. To each of the pixels 13, the signal lines 11 are connected in the vertical direction, and the reset line RST, the first gate line GT1 and the second gate line GT2 are connected in the horizontal direction as in the first embodiment. Each one end of the signal lines 11 is connected to the signal voltage output circuit 23, and each one end of the reset line RST and the gate lines GT1 and GT2, to the scanning circuit 22. Although only six pixels are shown in FIG. 1 for the sake of simplifying the drawing, the actual number of pixels is 240 (horizontal)×RGB×320 (vertical) pixels. All the pixels in the display area 21 are the same in pitch size. Also, all the pixels in the display area 21 are disposed over the same glass substrate.

Here, the pixel drive signal lines 15 are connected at each one end of the pixels to a pixel drive signal selecting circuit 40, and the pixel drive signal line 15A or 15B is selectively connected within the pixel drive signal selecting circuit 40.

This embodiment operates in the same way and has the same features as the first embodiment except that the pixel drive signal selecting circuit 40 selectively connects each row to the pixel drive signal line 15A or 15B.

Further, as this embodiment has the pixel drive signal selecting circuit 40, it can dynamically alter the signal-brightness display characteristics according to image signals to be displayed on the display.

Sixth Embodiment

A sixth preferred embodiment of image display device according to the invention will be described with reference to FIG. 11.

Figure 11:
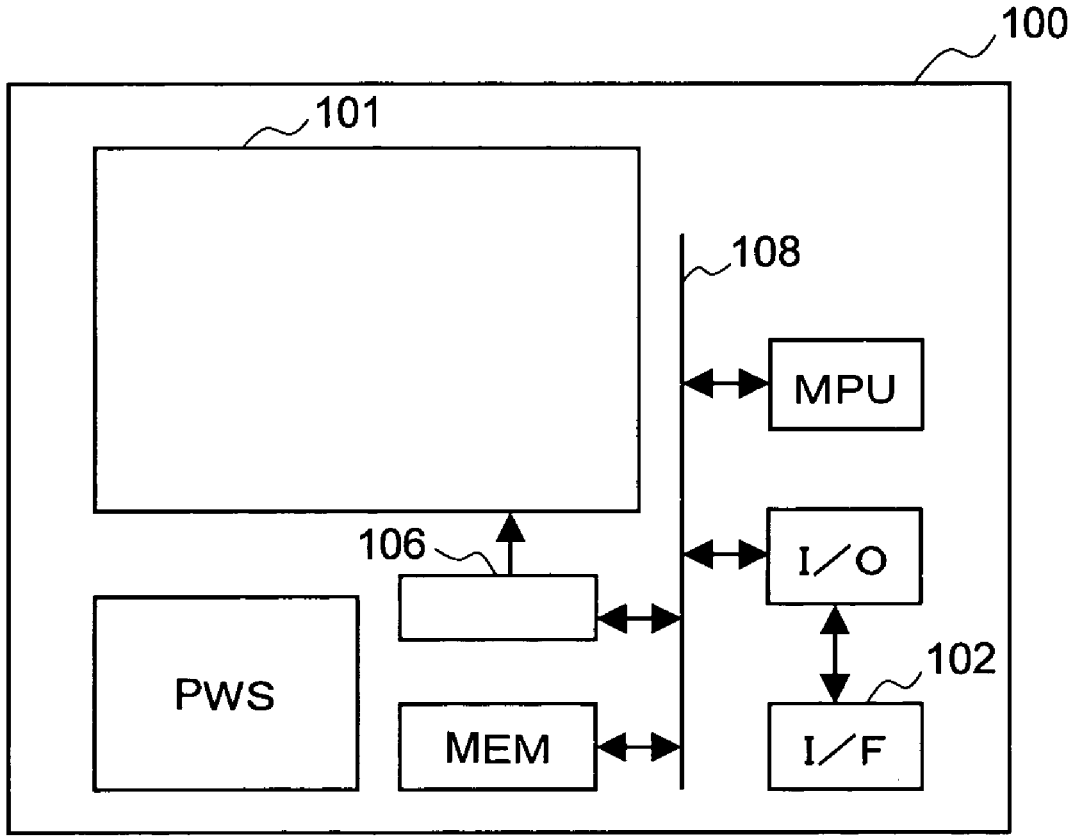
FIG. 11 shows the configuration of a TV image display device, which is a sixth preferred embodiment of image display device according to the invention.
Figure 12:
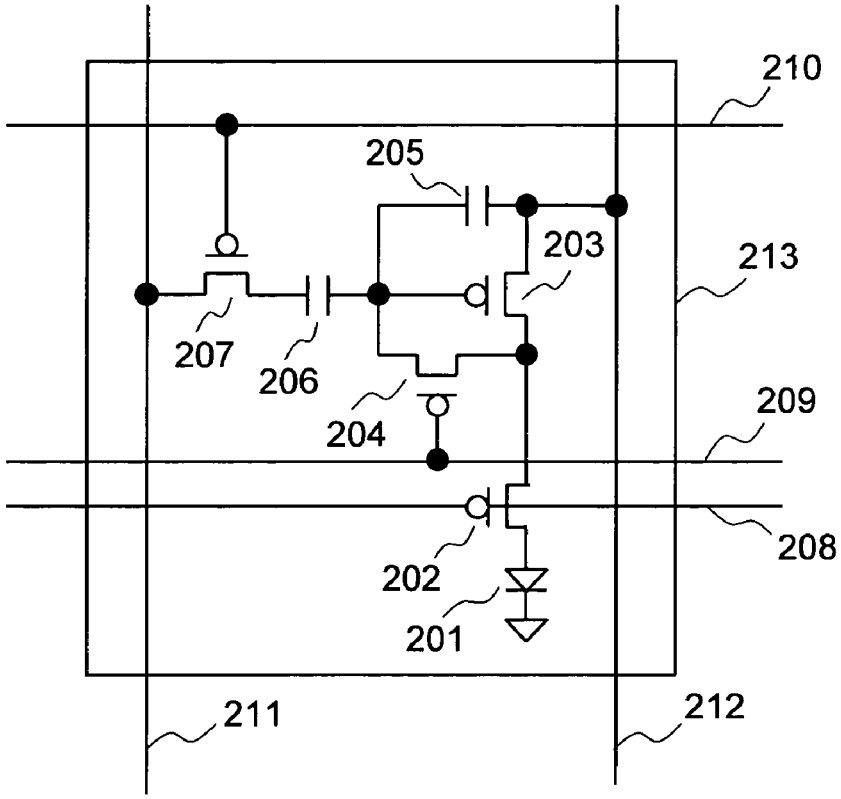
FIG. 12 is a pixel circuit of a conventional OLED display.
Figure 13:
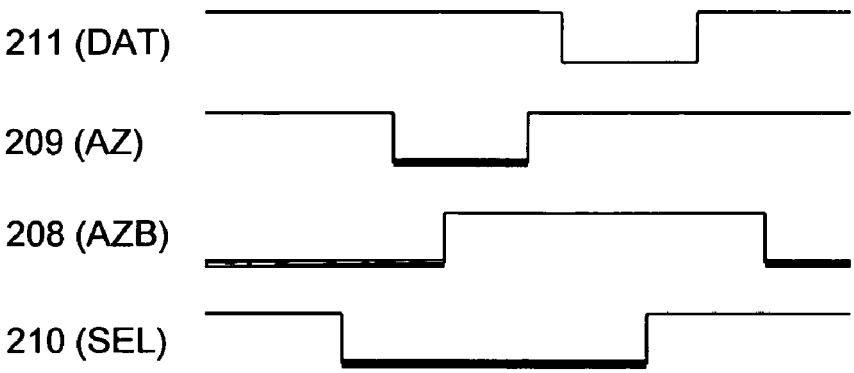
FIG. 13 is an operation timing chart of a conventional OLED display.

FIG. 11 shows the configuration of a TV image display device 100. Compressed image data and the like are entered from outside as wireless data into a wireless interface (I/F) circuit 102 which receives terrestrial wave digital signals among others, and the output of the wireless I/F circuit 102 is connected to a data bus 108 via an input/output (I/O) circuit. Besides this output, a microprocessor (MPU), a display panel controller 106, a frame memory (MEM) and so forth are connected to the data bus 108. Further, the output of the display panel controller 106 is entered into an OLED display panel 101. The image display terminal 100 is further provided with a power supply PWS. To add, as the OLED display panel 101 here has the same configuration and operates in the same way as the fifth embodiment described earlier, the description of its internal configuration and operation is dispensed with here.

The operation of this embodiment will now be described. First, the wireless I/F circuit 102 captures from outside image data compressed as instructed, and transfers these image data to the MPU and the frame memory via the I/O circuit. The MPU 104, in response to an instructing operation by the user, drives the whole image display terminal 100 as required to perform decoding of the compressed image data, signal processing and information displaying. Incidentally, the image data having undergone signal processing can be temporarily stored in the frame memory.

If hereupon the MPU 104 issues a display instruction, image data is entered from the frame memory MEM into the OLED display panel 101 via the display panel controller 106 in accordance with that instruction, and the OLED display panel 101 displays the entered image data on a real-time basis. Then, the display panel controller 106 supplies a prescribed timing pulse required for simultaneous displaying of the image, determines according to the image content the choice of the level of light emission brightness differing from one pixel group to the other in accordance with the display image data, and controls the pixel drive signal selecting circuit 40 by a prescribed algorithm. To add, it was already stated with reference to the fifth embodiment that the OLED display panel 101 would use these signals to display the entered image data on a real-time basis. The power supply PWS here includes a secondary battery, and supplies power to drive this whole image display terminal 100.

This embodiment can provide the image display terminal 100 capable of displaying with high picture quality. Although this embodiment uses as the image display device an OLED display panel described with reference to the fifth embodiment, it is obvious that various other display panels described with reference to other embodiments of the invention can be used as well. It is also obvious that, in this case, some circuit modifications would be needed in this case according to the structure of the OLED display panel.

According to the invention, images in which natural pictures and texts are mixed can be displayed with high picture quality by distinguishing in the frame natural pictures and other image sources including texts from each other, and signal-brightness characteristics can be controlled to match a single image signal source.

What is claimed is:

1. An image display device comprising:

an analogue image signal voltage generating circuit for supplying an analogue image signal voltage;

pixels each having an OLED element, a drive TFT, a reset switch, and a memory capacitor; and a display unit in which a plurality of said pixels are arranged, wherein the pixels comprise a first group of pixels and a second group of pixels, the first group of pixels are located in a first area for displaying mainly texts and icons, and the second group of pixels are located in a second area for displaying mainly natural pictures, wherein, in each pixel, one end of the OLED element is connected with a common electrode, the other end of the OLED element is connected with the power supply line via the drive TFT, the reset switch is connected with a gate and a drain of the drive TFT, and the gate of the drive TFT is connected with a first end of the memory capacitor, and wherein a first pixel drive signal line is connected to respective second ends of the memory capacitors in the pixels arranged in the first group of the pixels, a second pixel drive signal line is connected to respective second ends of the memory capacitors in the pixels arranged in the second group of the pixels, while the reset switch is turned ON, the analogue image signal voltage is inputted from the image signal lines to the second ends of memory capacitors in the pixels, while the reset switch is turned OFF, a constant voltage is applied from the first pixel drive signal line to the second ends of the memory capacitors in the pixels arranged in the first group of pixels such that the light emission brightness of the first group of pixels is modulated in response to a drive voltage applied to each drive TFT in each pixel of the first group of pixels being a difference between the analogue image signal voltage and the constant voltage, and a symmetric triangular waveform is applied from the second pixel drive signal line to the second ends of the memory capacitors in the pixels arranged in the second group of pixels such that light emission brightness of the second group of pixels is modulated in response to a drive voltage applied to each drive TFT in each pixel of the second group of pixels being a difference between the analogue image signal voltage and the symmetric triangular waveform, and the first group of pixels and the second group of pixels are substantially equal in emission spectrum and differ from each other in light emission brightness for the same level of said analogue image signal voltage supplied by said analogue image signal voltage generating circuit.

2. The image display device according to claim 1, wherein said display unit is formed over an insulating substrate.

3. The image display device according to claim 1, wherein a first group of pixels and a second group of pixels are determined in advance for said pixels by a wiring layout, said first group of pixels being substantially equal in light emission brightness for the same level of said analogue image signal voltage, and said second group of pixels being substantially different in light emission brightness for the same level of said analogue image signal voltage.

4. The image display device according to claim 3, wherein said first pixel group and said second pixel group are equal in pixel pitch size.

5. The image display device according to claim 3, wherein an analogue image signal voltage specified in advance for icons, texts and the like is written into said first pixel group and a usual analogue image signal voltage for natural pictures and the like are written into said second pixel group.

6. The image display device according to claim 3, wherein said first pixel group and said second pixel group are provided over different insulating substrates.

7. The image display device according to claim 3, further comprising a pixel drive signal selecting circuit for selecting, with respect to the same level of said analogue image signal voltage supplied by the same analogue image signal voltage generating circuit, which pixel group is to output different light emission brightness.

8. The image display device according to claim 7, wherein said pixel group is selected row by row.

9. The image display device according to claim 3, further comprising a selected pixel determining circuit unit for determining said selection of which pixel group is to output different light emission brightness according to the image content.

10. The image display device according to claim 1, wherein the brightness control unit of said light-emitting device performs brightness control by modulating the light emitting durations of the light-emitting devices.

11. The image display device according to claim 1, wherein said display unit comprises first and second pixel groups in each of which said plurality of pixels are arrayed; said first pixel group has a peak brightness characteristic, which is a light emission brightness characteristic modulated by the total light emission quantity of said display unit; and said second pixel group has no peak brightness characteristic.

12. The image display device according to claim 11, wherein said first pixel group and said second pixel group differ in the shape of the drive voltage waveform that is entered into pixels at the time of light emission.

13. The image display device according to claim 1, wherein said display unit comprises first and second pixel groups in each of which said plurality of pixels are arrayed, and said first pixel group and said second pixel group differ in the gamma characteristics of the light emission brightness.

14. The image display device according to claim 13, wherein said first pixel group and said second pixel group differ in the shape of the drive voltage waveform that is entered into pixels at the time of light emission.

15. The image display device according to claim 1, wherein said display unit comprises first and second pixel groups in each of which said plurality of pixels are arrayed, and the gradation width of the light emission brightness relative to the gradations of said analogue image signal voltage in said second pixel group is greater than the gradation width of the light emission brightness relative to the gradations of said analogue image signal voltage in said first pixel group.

16. The image display device according to claim 15, wherein said first pixel group and said second pixel group differ in the level of power supply voltage entered into the pixels.

17. The image display device according to claim 16, wherein the level of said power supply voltage differs with the color of the light emitted by the light-emitting device.

18. An image display device comprising:

an analogue image signal voltage generating circuit for supplying an analogue image signal voltage;

pixels each having an OLED element, a drive TFT, a reset switch, and a memory capacitor; and a display unit in which a plurality of said pixels are arranged, wherein the pixels comprise a first group of pixels and a second group of pixels, the first group of pixels are located in a first area for displaying mainly texts and icons, and the second group of the pixels are located in a second area for displaying mainly natural pictures, wherein, in each pixel, one end of the OLED element is connected with a common electrode, the other end of the OLED element is connected with the power supply line via the drive TFT, the reset switch is connected with a gate and a drain of the drive TFT, and the gate of the drive TFT is connected to a first end of the memory capacitor, and wherein a first pixel drive signal line is connected to respective second ends of the memory capacitors in the pixels arranged in the first group of the pixels, a second pixel drive signal line is connected to respective second ends of the memory capacitors in the pixels arranged in the second group of the pixels, while the reset switch is turned ON, the analogue image signal voltage is inputted from the image signal lines to the second ends of memory capacitors in the pixels, while the reset switch is turned OFF, a triangular waveform composed of straight lines is applied from the first pixel drive signal line to the second ends of the memory capacitors in the pixels arranged in the first group of pixels such that the light emission brightness of the first group of pixels is modulated in response to a drive voltage applied to each drive TFT in each pixel of the first group of pixels being a difference between the analogue image signal voltage and the triangular waveform composed of straight lines, and a triangular waveform composed of curves being convex upward is applied from the second pixel drive signal line to the second ends of the memory capacitors in the pixels arranged in the second group of pixels such that light emission brightness of the second group of pixels is modulated in response to a drive voltage applied to each drive TFT in each pixel of the second group of pixels being a difference between the analogue image signal voltage and the triangular waveform composed of convex curves, and the first group of pixels and the second group of pixels are substantially equal in emission spectrum and differ from each other in light emission brightness for the same level of said analogue image signal voltage supplied by said image signal voltage generating circuit.

* * * * *